US012059598B2

(12) United States Patent
Chiang et al.

(10) Patent No.: US 12,059,598 B2
(45) Date of Patent: Aug. 13, 2024

(54) HEAD STRAP DEVICE

(71) Applicant: Global Esprit Inc., New Taipei (TW)

(72) Inventors: Herman Chiang, New Taipei (TW); Tsai-Tung Wang, New Taipei (TW)

(73) Assignee: GLOBAL ESPRIT INC., New Taipel (TW)

( * ) Notice: Subject to any disclaimer, the term of this patent is extended or adjusted under 35 U.S.C. 154(b) by 0 days.

(21) Appl. No.: 17/514,070

(22) Filed: Oct. 29, 2021

(65) Prior Publication Data

US 2023/0019777 A1 Jan. 19, 2023

(30) Foreign Application Priority Data

Jul. 13, 2021 (TW) ..... 110208293

(51) Int. Cl.
*A63B 33/00* (2006.01)

(52) U.S. Cl.
CPC ..... *A63B 33/004* (2020.08)

(58) Field of Classification Search
CPC ..... A61F 9/026; A61F 9/027; A63B 33/002; A63B 33/004; B63C 11/12; B63C 2011/128; G02C 3/002; G02C 3/003
See application file for complete search history.

(56) References Cited

U.S. PATENT DOCUMENTS 5,303,428 A * 4/1994 Pernicka ..... A63B 33/004 2/452
5,408,702 A * 4/1995 Chiang ..... A63B 33/006 2/452
7,062,798 B2 * 6/2006 Wu ..... A61F 9/026 2/448
10,137,036 B2 * 11/2018 Fujimoto ..... B63C 11/12

* cited by examiner

*Primary Examiner* — F Griffin Hall
(74) *Attorney, Agent, or Firm* — Cheng-Ju Chiang

(57) ABSTRACT

The present invention is to provide a head strap device which includes a head strap having a first set of connecting section, a second set of connecting section, and a central section, and an adjustment buckle for positioning and adjusting the head strap, characterized in that: the central section of the head strap is a curved surface that can be naturally approach engagement on a back of the head while worn to avoid the head strap sliding, in addition, an opening disposed within a body of the adjustment buckle, and a pins and a guide posts disposed with misaligned each other on the opening that can separate the overlapping head strap after assembled, so that there is no need to remove the swimming goggles when the head strap is worn and adjusted, to achieve the effect of easily use.

12 Claims, 18 Drawing Sheets

--Prior Art--

--Prior Art--

--Prior Art--

--Prior Art--

105'
104'
105'
104'
105'
104'
105'
104'
105'
104'
A-A
B-B
C-C
D-D
E-E

HEAD STRAP DEVICE

BACKGROUND OF THE INVENTION

1. Field of the Invention

The present invention relates to a head strap device in particular to one for wearing on a head and with frames, such as a lens frame of swimming goggles, which can provide the lens frame to wear comfortably and make a head strap of the head strap device naturally fits a back of the head so that it will not slide, and there will be no risk of water leakage, and it can provide the effect of convenient adjustment of the head strap when wearing.

2. Related Art

The head strap device is mainly used to connect with the frame body to be worn on the head. The head strap device includes a head strap and an adjustment buckle for positioning and adjusting the head strap. For the head strap of swimming goggles is concerned, as shown in FIG. 1, the head strap 6 includes a first set of connecting section 60, a second set of connecting section 61 and a central section 62, wherein the first set of connecting section 60 and the second set of connecting section 61 is used to connect with a swimming goggles frame. Further refer to FIGS. 2A to 2C for better comprehension, the following instructions only introduce the first set of connecting section 60 of the head strap 6 is used to introduce the situation of threading around the frame of the swimming goggles and the adjustment buckle, in order to facilitate explanation of the following embodiment. In actual implementation, the second set of connecting section 61 of the head strap 6 is in the same way of threading. As shown in FIG. 2A, the first set of connecting section 60 of the head strap 6 passes through the through hole 80 and the notch 81 of an adjusting buckle 8, and then passes through a fixing hole 71 of the swimming goggles frame 7. Also refer to FIGS. 2B to 2C and cooperate with the FIG. 1, pass through the through hole 80 of the adjusting buckle 8 and fix it in the notch 81. Please refer back to FIG. 1 in conjunction with FIG. 3 to view the central section 62 of the head strap 6. The central section 62 of the head strap 6 is provided with an elongated opening 63 in the center, which divides the central section 62 of the head strap 6 into an upper split section 621 and a lower split section 622, The lower split section 622 provides the goggles to maintain a lateral pull on the swimmer's head while the upper split section 621 provides oblique pull, so that it can be worn to match the swimmer's head with a different head shape after wear. With the lateral pulling force of the lower split section 622 and the diagonal pull of the upper split section 621 at different angles, the swimming goggles can fit on the eye socket to avoid water leakage.

However, the first set of connecting section 60 and the second set of connecting section 61 of the head strap 6 is the main force when the swimming goggles are worn on the head strap and the head strap 6 is tightened, please refer to FIG. 3, the lower split section 622 is directly connected and pulled, the upper split section 621 is not directly connected to force which is pulled indirectly by oblique due to the back of the head is curved. Therefore, the upper split section 621 and the lower split section 622 bear the tension unevenly. The pulling force of 621 will not only cause discomfort and uncomfortable wearing, but also the upper split section 621 and the lower split section 622 can easily affect each other, so that the upper split section 621 slides along the back of the swimmer's head (as shown by the dashed line in FIG. 3), once sliding, regardless of the displacement, the oblique angle drawn by the upper split section 621 will change, and the swimming goggles originally pulled firmly on the swimmer's head will loosen, so as to cannot make the swimming goggles close to the eye sockets, resulting in water leakage.

Furthermore, the swimming goggles must be taken off first, when adjusting the length of the head strap, please refer to FIGS. 2B to 2C, and take the reverse action of FIG. 2C to FIG. 2B when adjusting, the first set of connecting section 60 of the head strap 6 is unbuckled from the notch 81 of the adjustment buckle 8 to adjust the length (the second set of connecting section 61 of the head strap 6 use the same unbuckled method). After the length is adjusted, wear it on the head. If you feel that the adjustment is not suitable, you must remove the goggles from the head again to adjust, and operate the above actions until it fits. In this way, therefore, put on and take off the swimming goggles for adjustment of the length of the head strap is very inconvenient.

SUMMARY OF THE INVENTION

Accordingly, an object of the present invention is to provide a head strap device, which assembles on a frame, such as a lens frame of swimming goggles, the head strap device can provide the lens frame to wear comfortably and make a head strap of the head strap device fits a back of the head so that it will not slide, and there will be no risk of water leakage, and it can provide the effect of convenient adjustment of the head strap when wearing.

To achieve the above-mentioned object, the head strap device of the present invention includes at least a head strap which is made of silicone material, and has a first set of connecting section and a second set of connecting section, and the central section located between the first set of connecting section and the second set of connecting section, in which the central section of the head strap is a curved surface, which fits the head when being worn.

In accordance with the present invention, the curved surface of the central section of the head strap has a top of the curved surface which is formed by a horizontal axis of the width center of the first set of connecting section and the second set of connecting section, and which divide the curved surface into an upper arc surface and a lower arc surface, in which the upper arc surface and the lower arc surface respectively have a first surface and a second surface, wherein the second surface is in contact with the back of the head.

In accordance with the present invention, the upper arc surface and the lower arc surface of the curved surface are extended symmetrically based on the top of arc surface.

In accordance with the present invention, the upper arc surface of the curved surface further has an extended convex surface on the first surface of the upper arc surface which is a continuous ribbed decoration, and which is formed passing through a junction point of the upper arc surface and the lower arc surface, and is respectively extended along both sides of the first set of connecting section and the second set of the head strap. The extended convex surface can help to increase the thickness of the upper arc surface of the curved surface and the first set of connecting section and the second set of the head strap, and can change the pulling tension of the upper arc surface of the curved surface based on a position and a quantity when the head strap is under tension, so as to make the extension magnification of the upper arc surface and the lower arc surface tends to be balanced, so that the tensile force of the wear is balanced.

In accordance with the present invention, the upper arc surface further has a plurality of drainage patterns formed on the second surface of the upper arc surface, and the drainage patterns have openings adjacent to the edges of the second surface of the upper arc surface, so that the formation of channels is conducive to the drainage effect, and reduce the sliding of the upper arc surface of the curved surface when moving in the water.

Another feature of the head strap device of the present invention is that a elongated opening is formed between the upper arc surface and the lower arc surface of the curved surface.

In accordance with the present invention, the elongated opening is formed symmetrically between the upper arc surface and the lower arc surface of the curved surface based on a horizontal axis which is a width centers of the first set and the second set of connecting section of the head strap.

In accordance with the present invention, wherein the first set and the second set of connecting section of the head strap are plate-shaped strips, and a shaft sleeve is provided at the ends of the plate-shaped strips.

The head strap device of the present invention further comprises an adjustment buckle having a body with an opening, and having a pin hole on a side of the opening of the body for a pin assembly, and having a guide post which is far away from a side of the pin hole, and which is divided the opening into a first through hole and a second through hole, and having a partition which is provided on the body near the side of the pin hole, and which shields a part of the first through hole; when the head strap is assembled with the lens frame and the adjustment buckle, to make the two free ends of the head strap passing through the guide post respectively, then pass through the first through hole of the body, and respectively pass through a rollers on both sides of the lens frame, and then the two free ends of the shaft sleeves are aligned with the pin holes and fixed on the body of the adjustment buckle by the pins. Thus, once the head strap is adjusted, there is no need to remove the swimming goggles, and just move the body directly toward a front of the swimming goggles (Refers to the front of the eyes after wearing) which can adjust the head strap in a loose state; on the contrary, the head strap is tension which can move the body directly toward a back of the swimming goggles (Refers to the back of the eyes after wearing) to achieve the effect of easily use.

DESCRIPTION OF THE PREFERRED EMBODIMENTS

Figure 1:
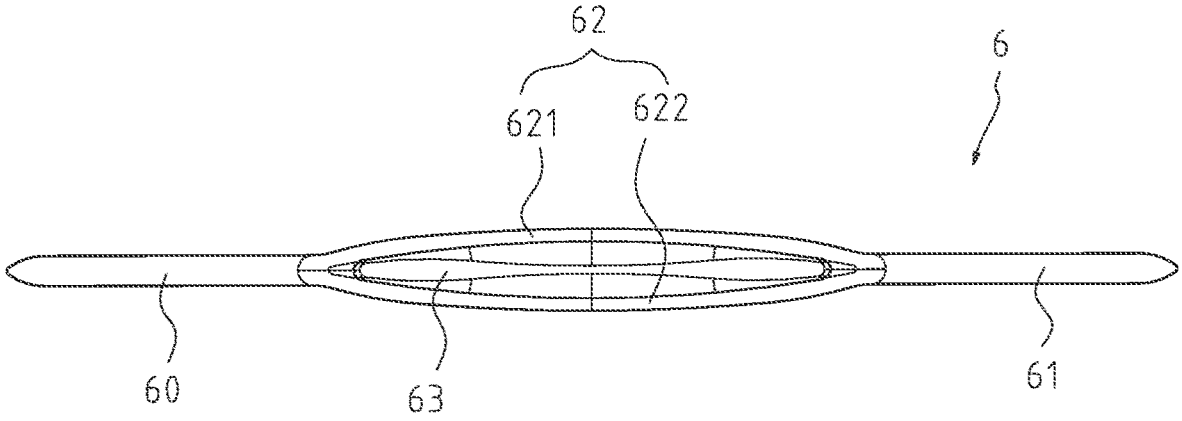
FIG. 1 is a plan view of the conventional head strap.
Figure 2A:
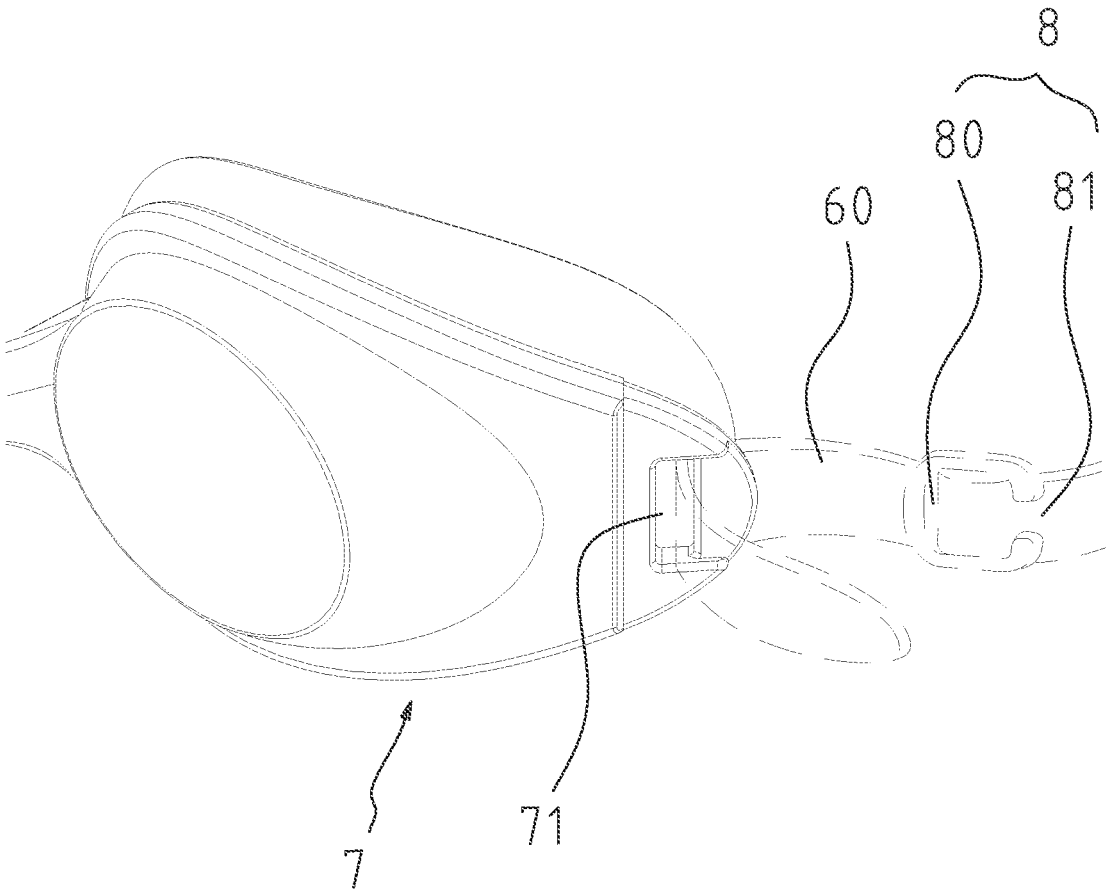
FIGS. 2A to 2C are schematic diagrams of the conventional head strap assembled on the lens frame of the swimming goggles.
Figure 2B:
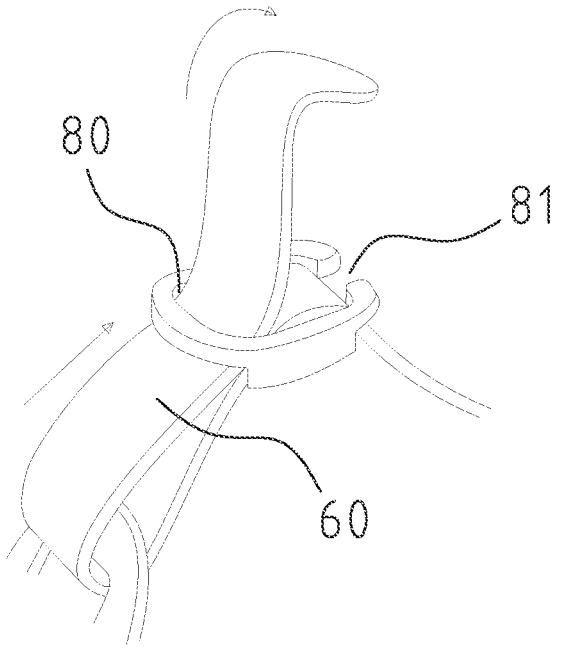
Figure 2C:
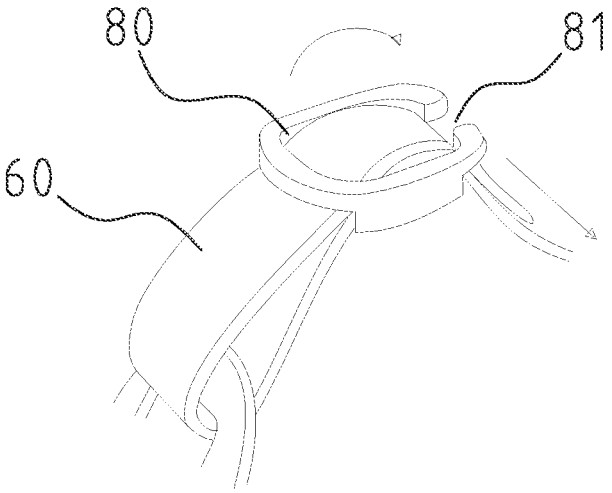
Figure 3:
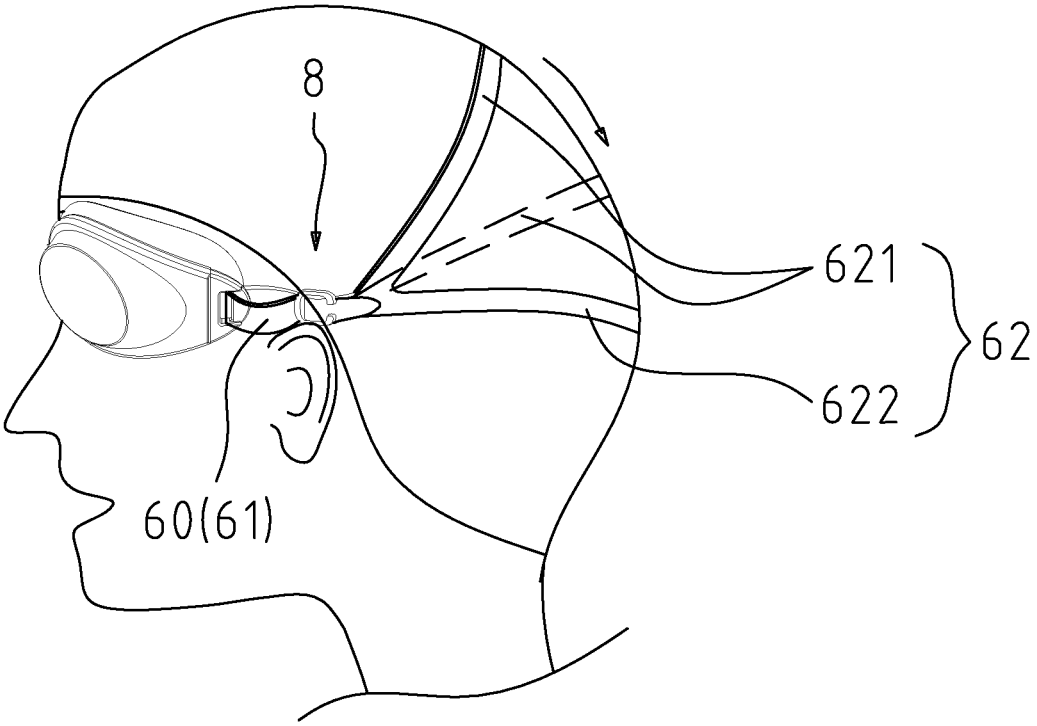
FIG. 3 is schematic diagram of the swimming goggles with conventional head strap that worn on the head.
Figure 4A:
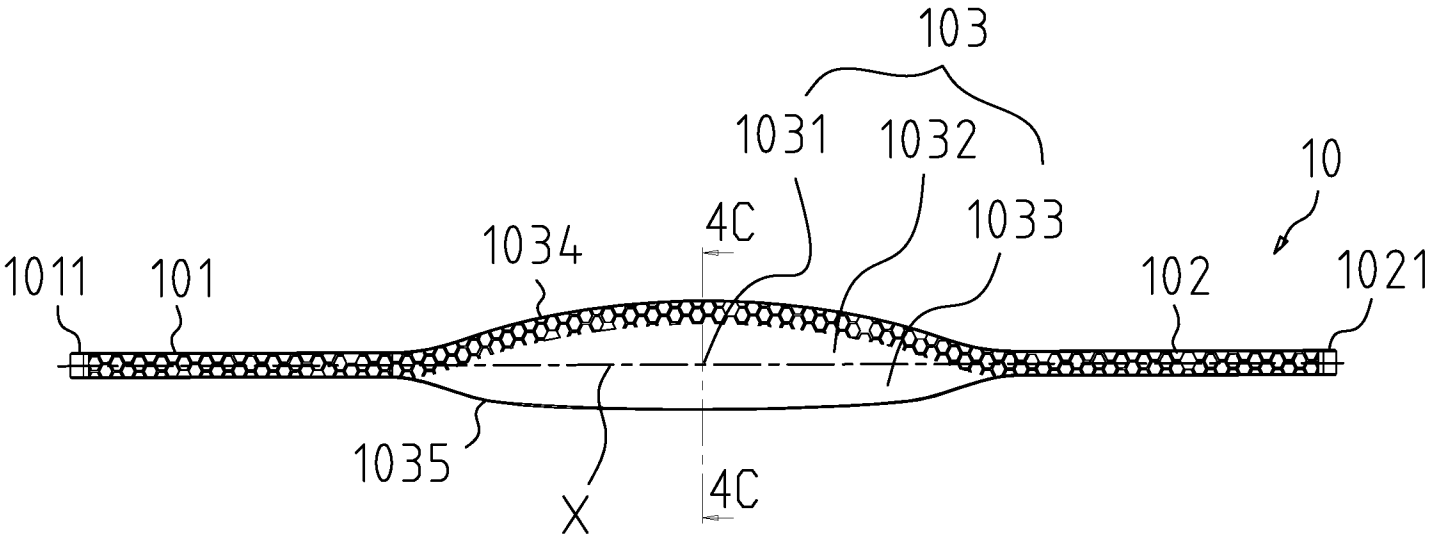
FIGS. 4A to 4H are the plan view of the head strap of the first embodiment of the head strap device of the present invention, the 4C-4C cross-sectional view, the perspective view and the partial enlarged view of the head strap from different perspectives, and the side view of the head strap of the present invention worn on the head.
Figure 4B:
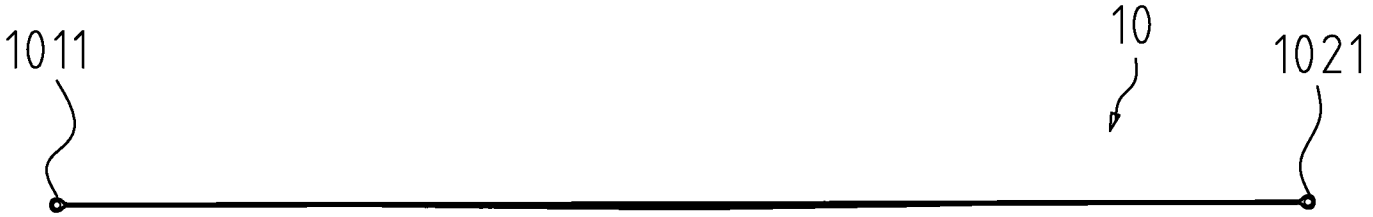
Figure 4C:
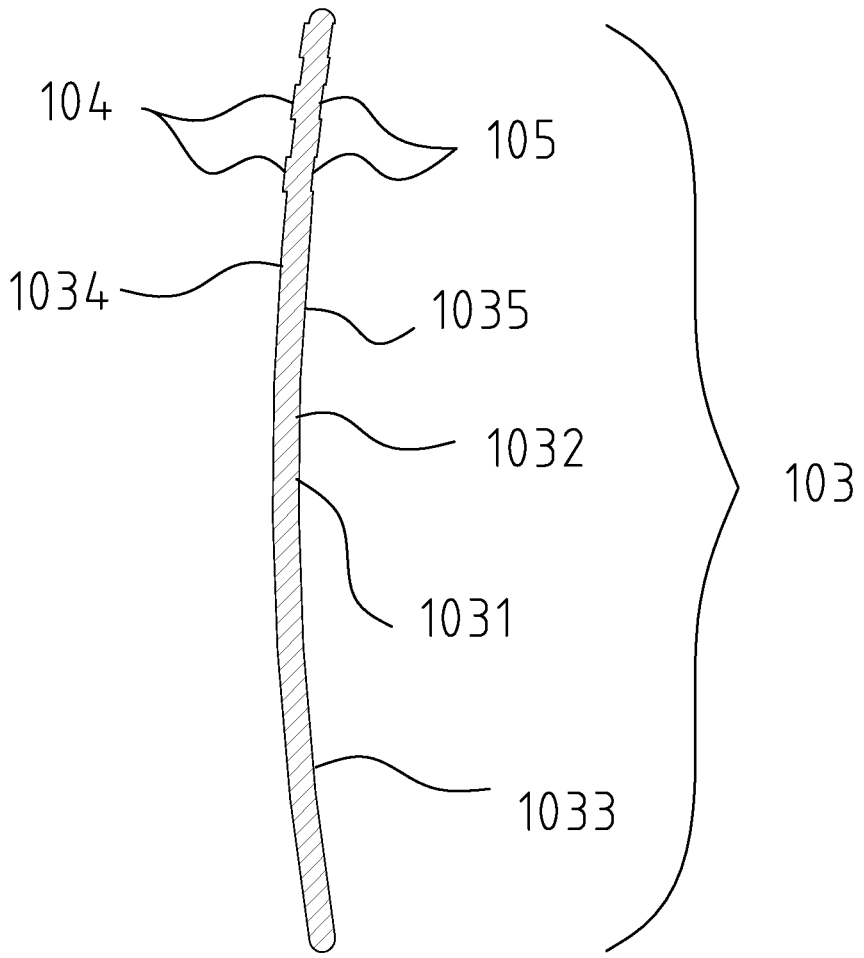

Please refer to FIGS. 4A to 4C for a plan view of the first embodiment of the head strap of the head strap device of the present invention and a cross-sectional view of 4C-4C. The head strap 10 of the head strap device of the present invention has a first set of connections. The first set of connecting section 101 and the second set of connecting section 102 and the central section 103, wherein the first set of connecting section 101 and the second set of connecting section 102 are plate-shaped strips, and a shaft sleeve 1011, 1021 are provided at the end of the plate-shaped strip, used to connect with an adjustment buckle 3. The central section 103 is a curved surface, and the horizontal axis X formed by the width center of the first set of connecting section 101 and the second set of connecting section 102 is used as the top 1031 of the curved surface 103 (that is, the highest point of the curved surface), it is divided into an upper arc surface 1032 and a lower arc surface 1033 based on the top 1031. Each of the upper arc surface 1032 and the lower arc surface 1033 have a first surface 1034 and a second surface 1035, wherein the second surface 1035 is contact with the back of the head.

Figures 4D, 4E:
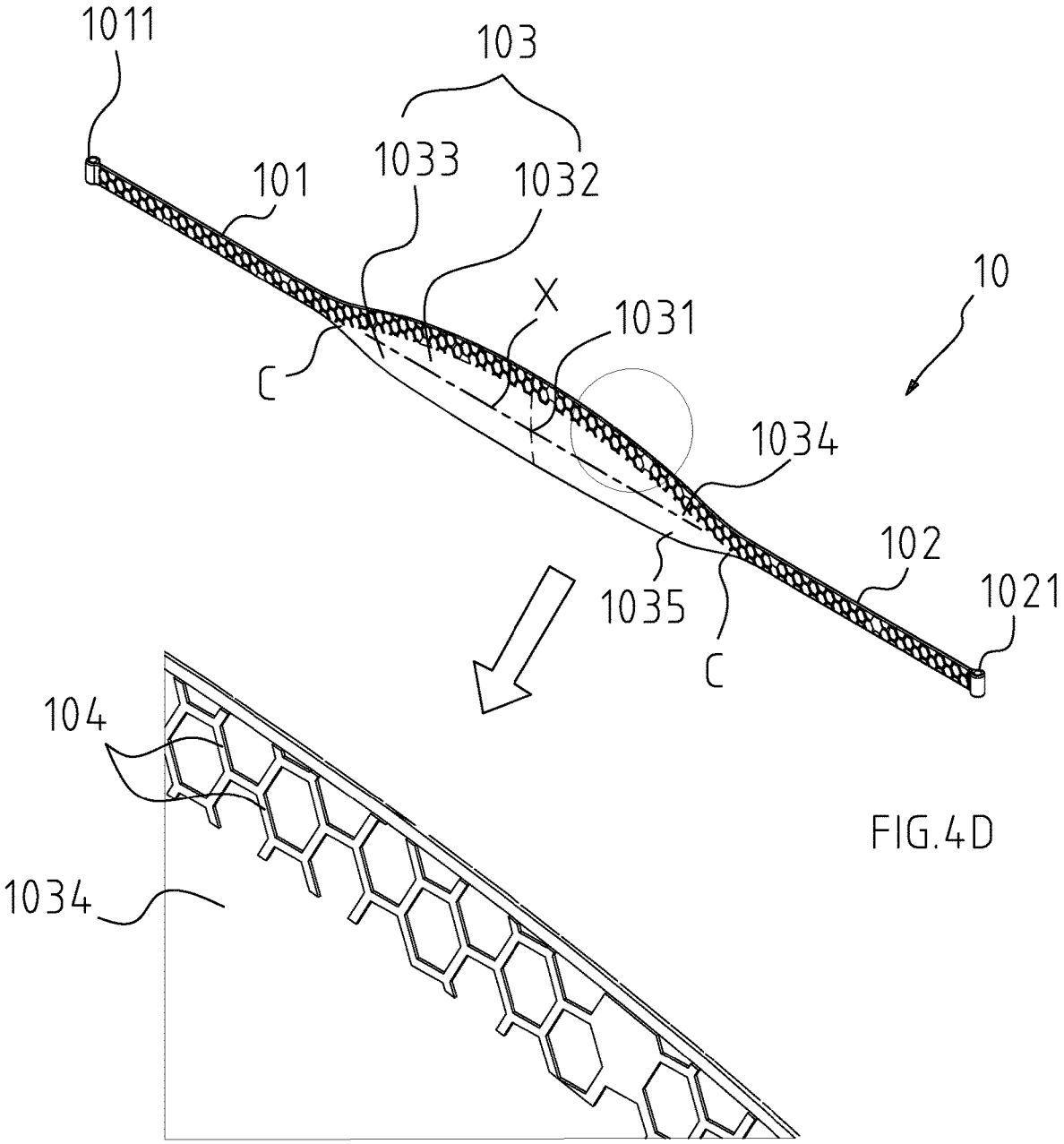
Figure 4F:
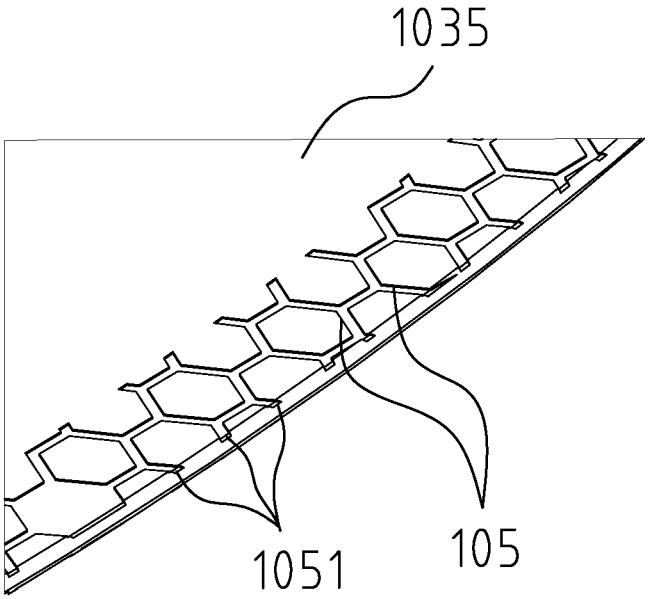
Figure 4G:
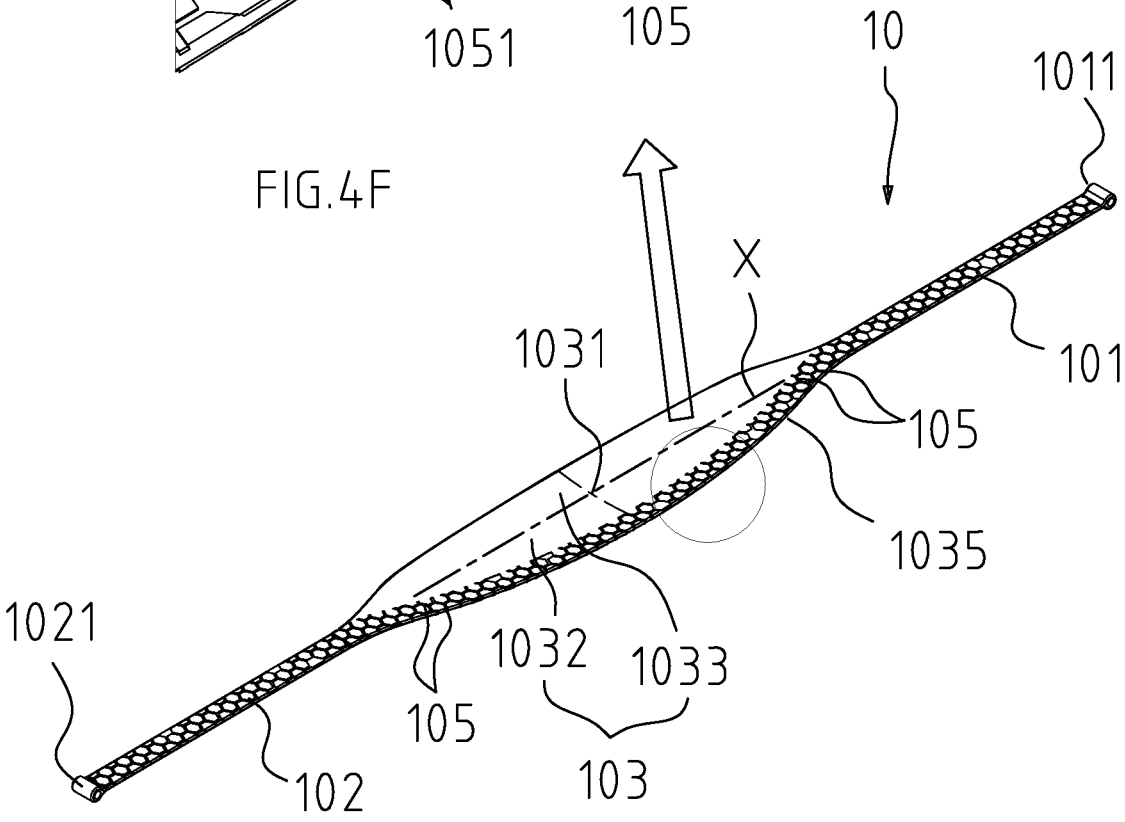
Figure 4H:
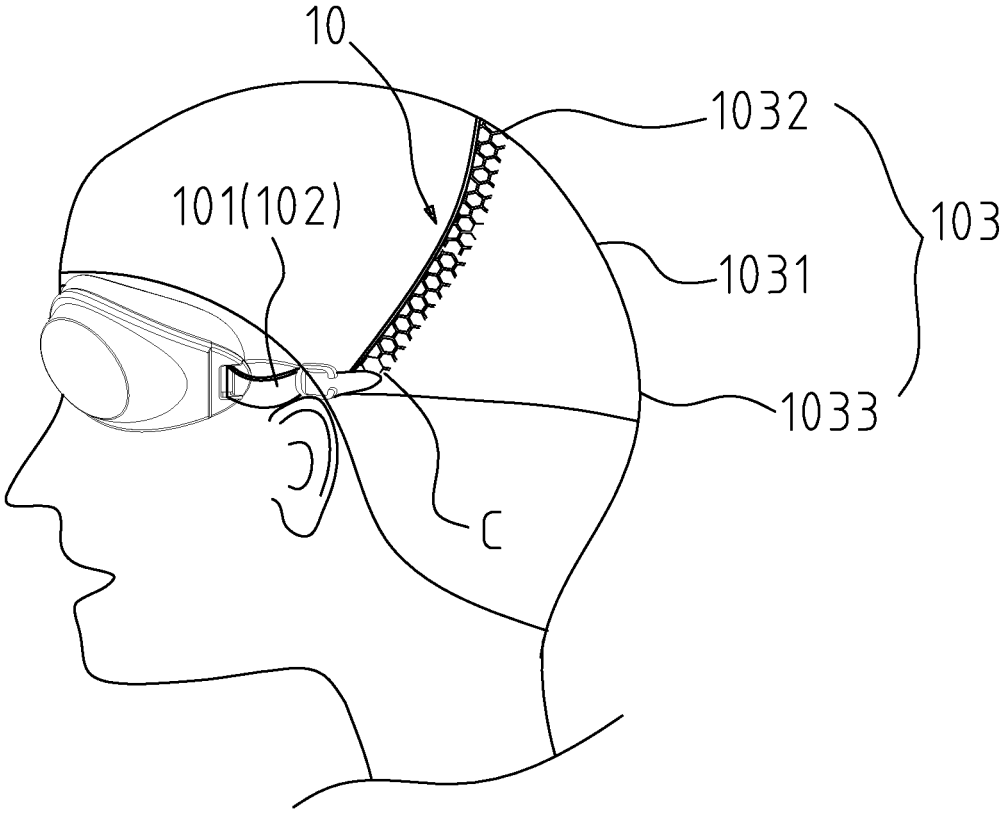

Please refer to FIGS. 4D and 4E and FIGS. 4F and 4G in conjunction with FIG. 4C, wherein FIGS. 4D and 4E shows that the upper arc surface 1032 forms an extended convex surface 104 on the first surface 1034, as depicted in FIG. 4C, the extended convex surface 104 is configured to be convex in an unloaded state. The extended convex surface 104 is a continuous ribbed decoration, which can balance the extension magnification of the upper arc surface 1032 and the lower arc surface 1033, and balance the tensile force of the wear. In other words, the upper arc surface 1032 is on the extended convex surface 104 of the first surface 1034 and crosses the junction C of the upper arc surface 1032 and the lower arc surface 1033, and is arranged along each side of the first set of connecting section 101 and the second set of connecting section 102, as shown in FIG. 4D, forming a continuous extension helps increase the thickness of the upper arc surface 1032 and each of the thickness of the first set of connecting section 101 and the second set of connecting section 102, that will change the pulling tension of the upper arc surface 1032 depending on the position and number of the extended convex surface 104. When the tensile force is applied, the extension magnification of the upper arc surface 1032 and the lower arc surface 1033 tends to be balanced, and the effect of wearing tensile force balance is achieved. In addition, FIGS. 4F and 4G show that the upper arc surface 1032 forms a plurality of drainage patterns 105 on the second surface 1035. The drainage patterns 105 have openings 1051 adjacent to the edges of the second surface 1035, so that the formation of a channel is conducive to the drainage effect when moving in the water, and can be reduced the upper arc surface 1032 sliding. Thus, it can be clearly seen that the central section 103 of the head strap 10 of the present invention is a curved surface, which naturally fits a back of the head will not slide, and there will be no risk of water leakage (please see FIG. 4H) when wearing. There is no need to wear the head strap by tilting and pulling force as is conventional.

Please refer to FIGS. 4D and 4E, the upper arc surface 1032 forms an extended convex surface 104 on the first surface 1034, which can make the extension magnification of the upper arc surface 1032 and the lower arc surface 1033 tend to be balanced, so that the pulling force of the wear is balanced, and be able to reduce the sliding of the extended convex surface 104. In addition, as shown in FIGS. 4F and 4G, the upper arc surface 1032 forms a plurality of drainage patterns 105 on the second surface 1035. The drainage patterns 105 are used to form channels, it is beneficial to drain the oncoming water resistance from the openings 1051 of the drainage patterns 105 when moving in the water, especially at the moment of diving, and the upper arc surface 1032 is prevented from sliding due to hydroplaning during the movement in the water. (Note: The phenomenon of hydroplaning occurs when the rolling tires lose contact with the road surface and float on the water film on the water-filled road. The head strap is used as the swimming goggles in the water between the movement process and the water resistance in the water, if there is no plural drainage pattern 105 design, it is easy to cause hydroplaning between the head strap and the head due to loss of contact, and make the head strap 10 sliding so as to affect the fit between the headband and the head). In addition, please refer to FIG. 4H, which is a schematic diagram of the head strap 10 of the present invention assembled in the swimming goggles and worn on the head. As shown in the figure, it can be clearly seen that the central section 103 of the head strap 10 is designed with its curved surface, which is able to conform to the back of the head without the need to wear it by oblique pulling force as is conventionally used when worn, and the central section 103 naturally fits the back of the head without sliding, and there is no risk of water leakage. Moreover, as shown in FIGS. 4D and 4E, the upper arc surface 1032 extends on the first surface 1034 to form a continuous extension of the extended convex surface 104, which helps increase the thickness of the upper arc surface 1032 and each side of the thickness of the first set and the second set of connecting section 101 and 102. Depending on the position and number of the extended convex surfaces 104, the pulling tension of the upper arc surface 1032 can be changed, and the extension magnification of the upper arc surface 1032 and the lower arc surface 1033 can be balanced when the head strap 10 is under tension, so as to achieve the wearing tension balance. Furthermore, as shown in FIGS. 4F and 4G, the upper arc surface 1032 is provided on the second surface 1035 with multiple drainage patterns 105, which can reduce the hydroplaning caused when moving in the water, and which can make the sliding of the central section 103 more reduced.

Figures 5A, 5B:
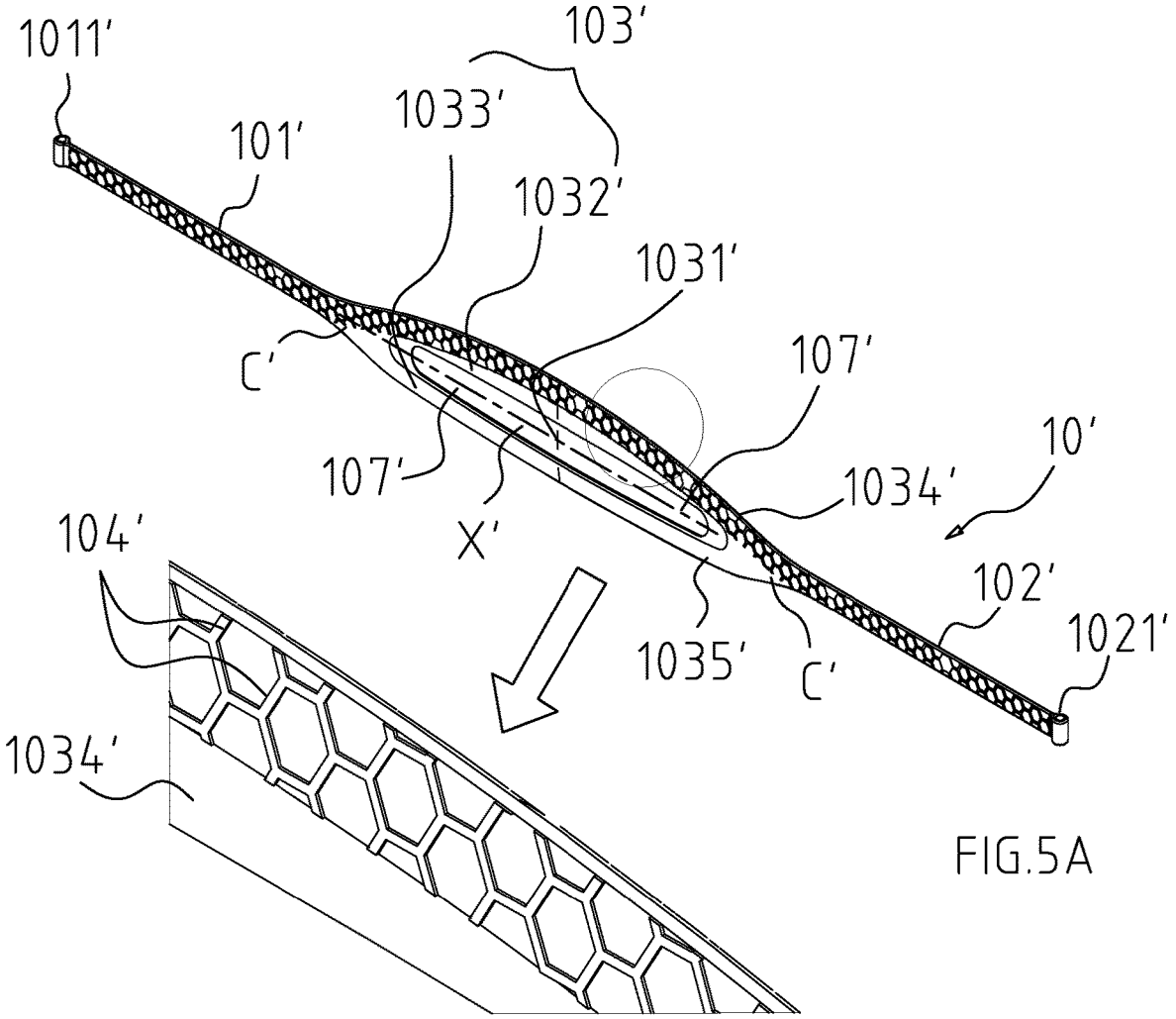
FIGS. 5A to 5E are perspective and partial enlarged views of the second embodiment of the head strap of the head strap device of the present invention, and a schematic diagram of the head strap assembled on the swimming goggles and worn on the head.
Figures 5C, 5D:
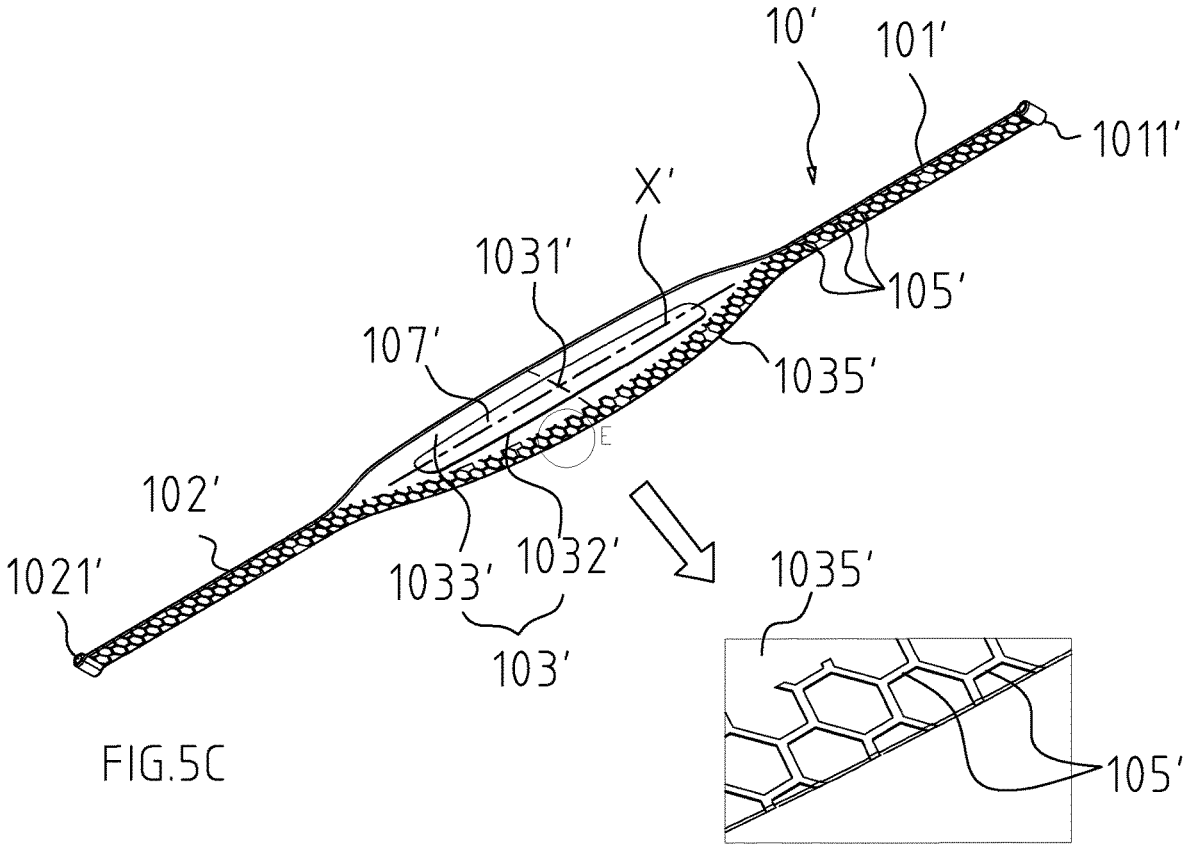

Please refer to FIGS. 5A to 5E for the second embodiment of the head strap of the head strap device of the present invention. As shown in the figure, the head strap 10' of the head strap device of this embodiment has a first set of connecting section 101' and the second set of connecting section 102' and central section 103'. The difference between this embodiment and the first embodiment is that an elongated opening 107 is formed between the upper arc surface 1032' and the lower arc surface 1033' of the central section 103', the elongated opening 107' takes the horizontal axis X' connected by the width center of the first set of connecting section 101' and the second set of connecting section 102' as the top 1031' of the arc surface (that is, the highest part of the arc), formed between the upper arc surface 1032' and the lower arc surface 1033', and other structures of this embodiment such as: extended convex surface 104', drainage pattern 105', the first set of connecting section 101' and the second set of connecting section 102', the end sleeves 1011' and 1021' are same with the first embodiment. Please refer to FIGS. 5A to 5E and 6 and 6A to 6E. The headband 10' of the headband device of this embodiment is provided with the upper arc surface 1032' and the lower arc surface 1033' of the central section 103', and an extended convex surface 104' is formed on the first surface 1034' of the upper arc surface 1032', can make the extension magnification of the upper arc surface 1032' and the lower arc surface 1033' tend to be balanced, so that the tensile force of the wear is balanced (as shown in FIGS. 5A and 5B). In addition, as shown in FIGS. 5C and 5D, the upper arc surface 1032' forms a plurality of drainage patterns 105' on the second surface 1035'. The drainage patterns 105' form a channel, which is beneficial for activities in the water (especially at the moment of diving) the oncoming water resistance is drained by the drainage patterns 105', and the upper arc surface 1032' is prevented from sliding due to hydroplaning during the activity in the water. In addition to the above-mentioned drainage patterns 105' provided on the upper arc surface 1032', in fact, they can also be provided on the second surface 1035' of the lower arc surface 1033', which can also provide the drainage effect when moving in the water and reduce the sliding of the lower arc surface 1033' forms a synergistic effect with the upper arc surface 1032'.

Figure 5E:
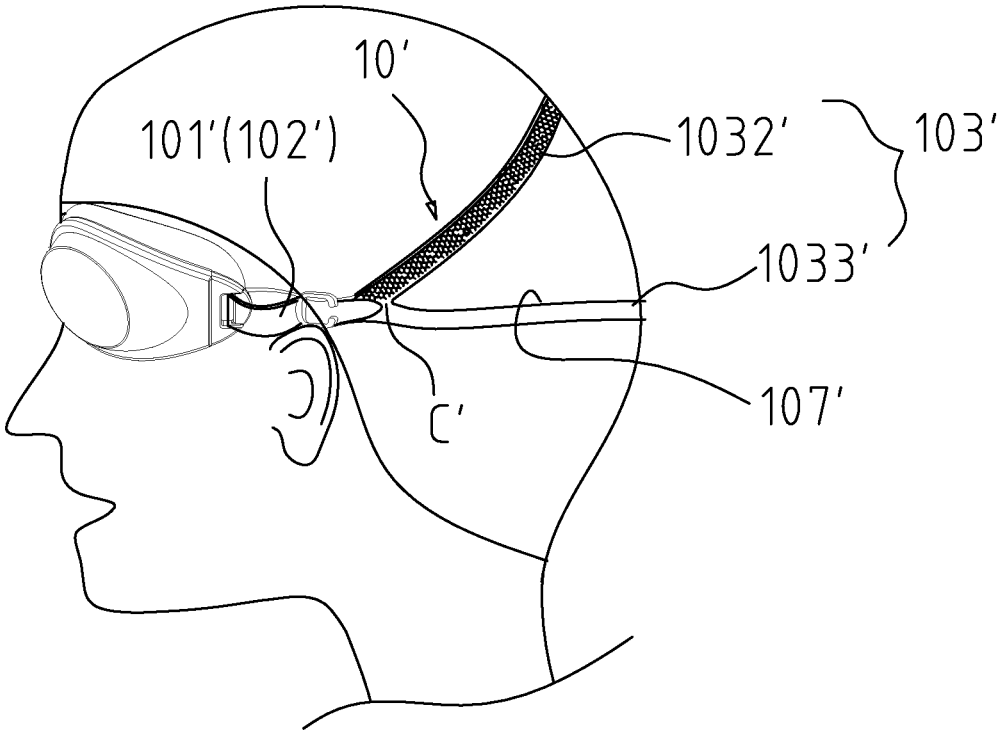
Figure 6:
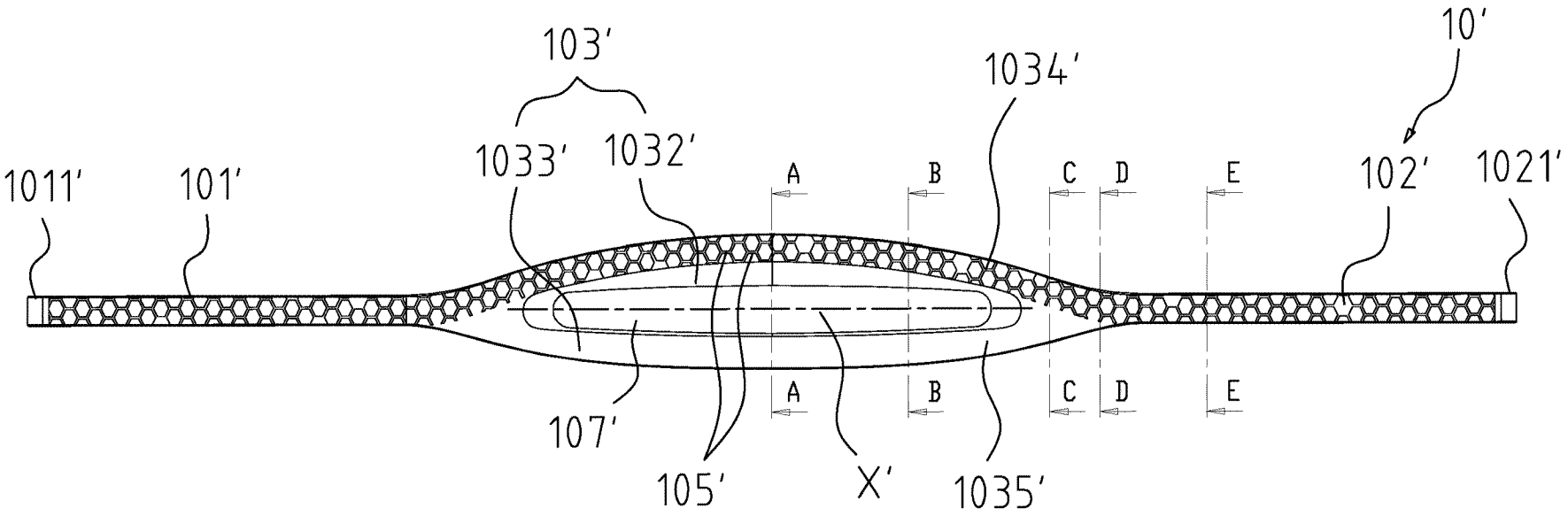
FIGS. 6 and 6A to 6E are a plan view of the second embodiment of the head strap of the head strap device of the present invention and cross-sectional views 6A-6A to 6E-6E.
Figures 6A, 6B, 6C, 6D, 6E:
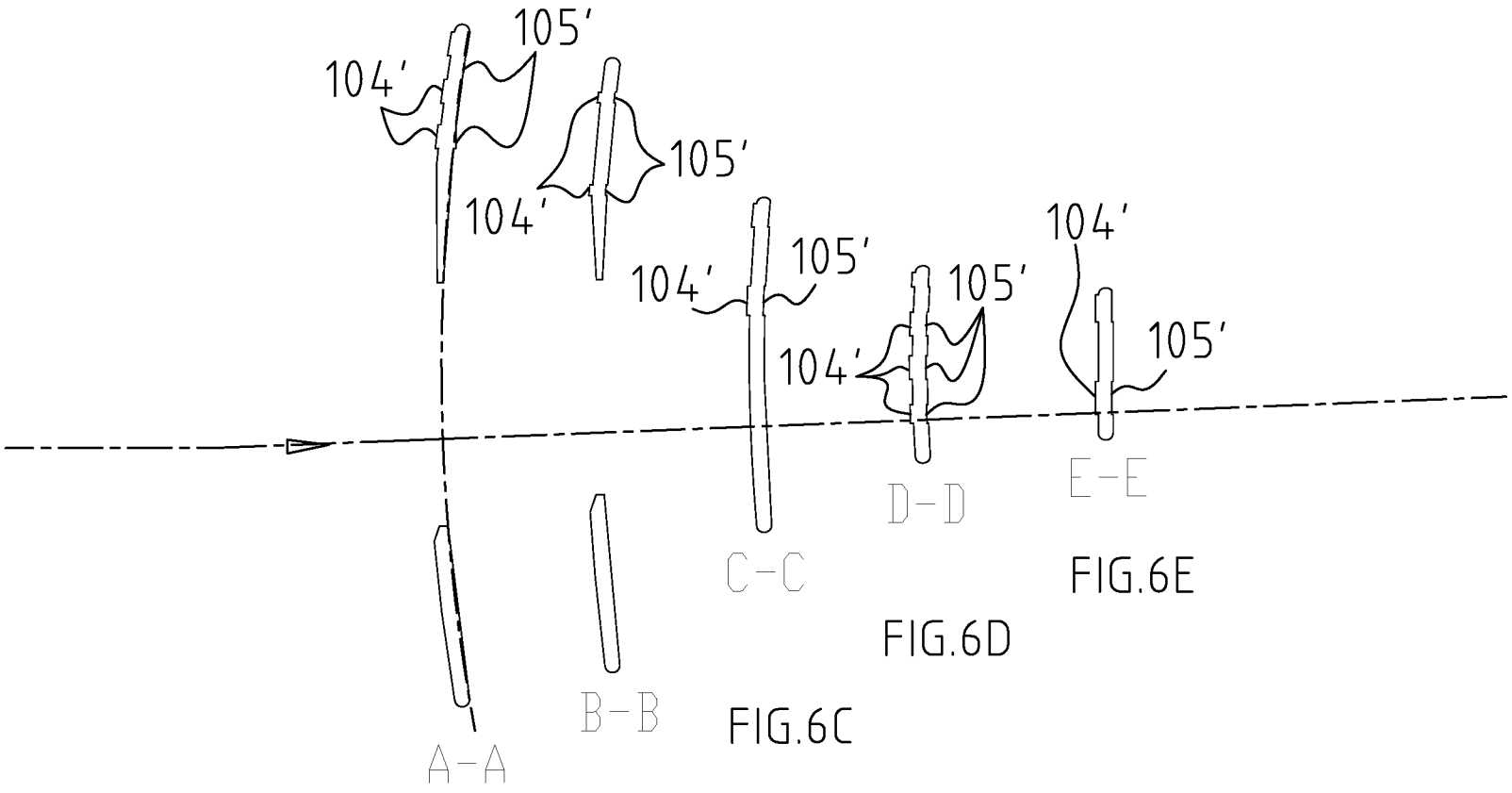

Please continue to refer to FIG. 5E for a schematic diagram of the head strap 10' and the swimming goggles being assembled and worn on the head. As shown in the figure, although the central section 103' of the head strap 10' has a elongated opening 107' like the conventional, however, the central section 103' is a curved surface, and the upper arc surface 1032' and the lower arc surface 1033' also curved surfaces. Therefore, when the head strap of the swimming goggles is tightened, the upper arc surface 1032' and the lower arc surface 1033' are designed to conform to the back of the head. It does not need to be worn by oblique pulling force as is conventional, but can naturally fit on the back of the head without sliding, and there will be no risk of water leakage. The upper arc surface 1032' extending the extended convex surface 104' on the first surface 1034' as shown in FIGS. 5A and 5B, the extended convex surface 104' can provide the extension magnification of the upper arc surface 1032' and the lower arc surface 1033' tends to be balanced, so that the wearing tension is balanced. In other words, when the head strap of the swimming goggles is tightened, the arc design of the upper arc surface 1032' and the lower arc surface 1033' can naturally fits the back of the head. Although the force is exerted on the first set of connecting sections 101' and the second set of connecting sections 102', but the upper arc surface 1032' extends the extended convex surface 104' on the first surface 1034', as shown in FIGS. 5A and 5E, the extended convex surface 104' crossing the junction C' of the upper arc surface 1032' and the lower arc surface 1033', and along each of the first set of connecting sections 101' and the second set of connecting sections 102', forming a continuous extension which can helps increase the thickness of the upper arc surface 1032' and each of the thickness of the first set of connecting sections 101' and the second set of connecting sections 102', Depending on the position and number of the extension convex surfaces 104', the pulling tension of the upper arc surface 1032' can be changed, and the extension magnification of the upper arc surface 1032' upper arc surface 1032' and the lower arc 1033' can be balanced when the head strap 10' is under tension, so as to achieve the wearing tension balance. Furthermore, as shown in FIGS. 5C and 5D, the upper arc surface 1032' is provided on the second surface 1035' with multiple drainage patterns 105', which can reduce the hydroplaning caused when moving in the water, and which can make the sliding of the central section 103' more reduced.

Figure 7A:
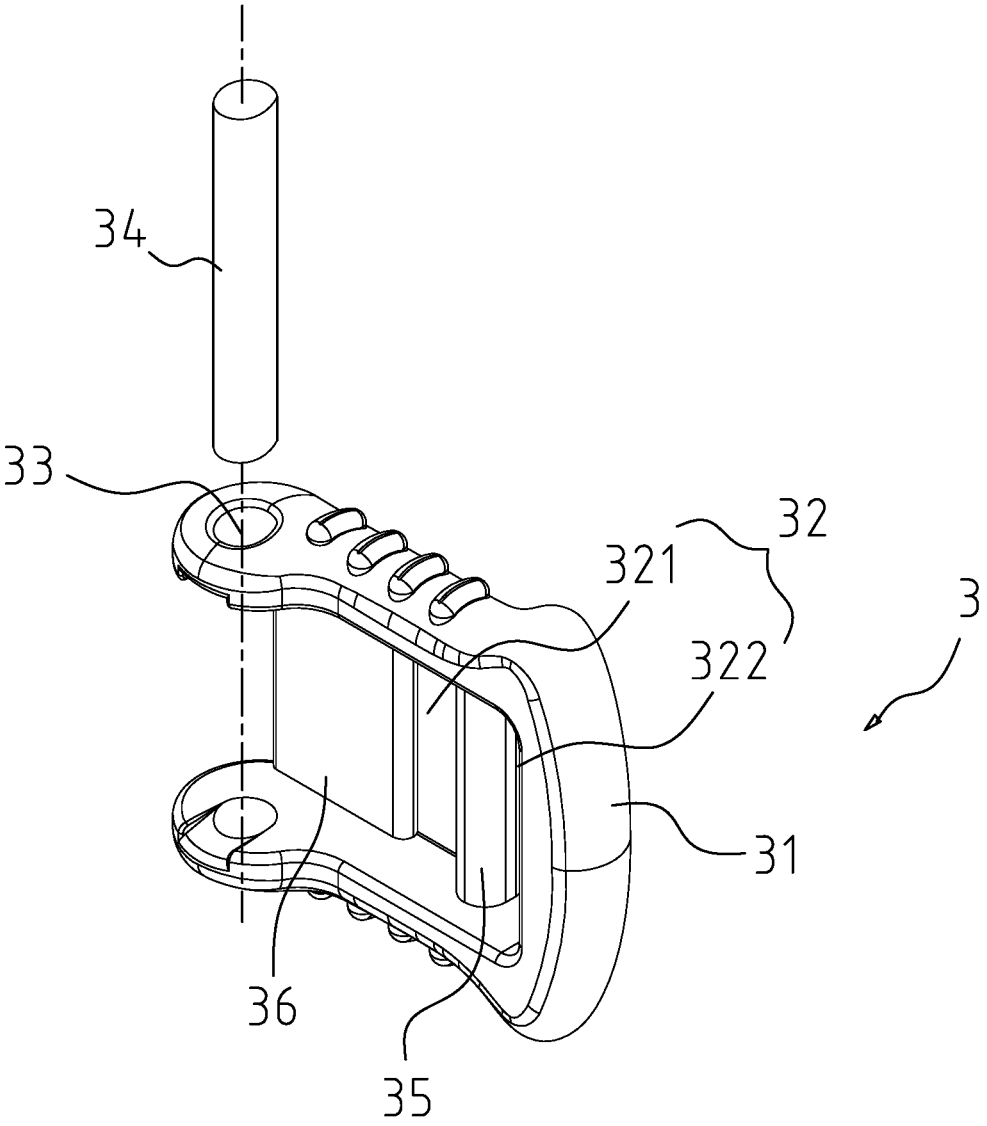
FIGS. 7A to 7C are the perspective view, plan view and 7C-7C cross-sectional view of the adjustment buckle of the head strap device of the present invention.
Figure 7B:
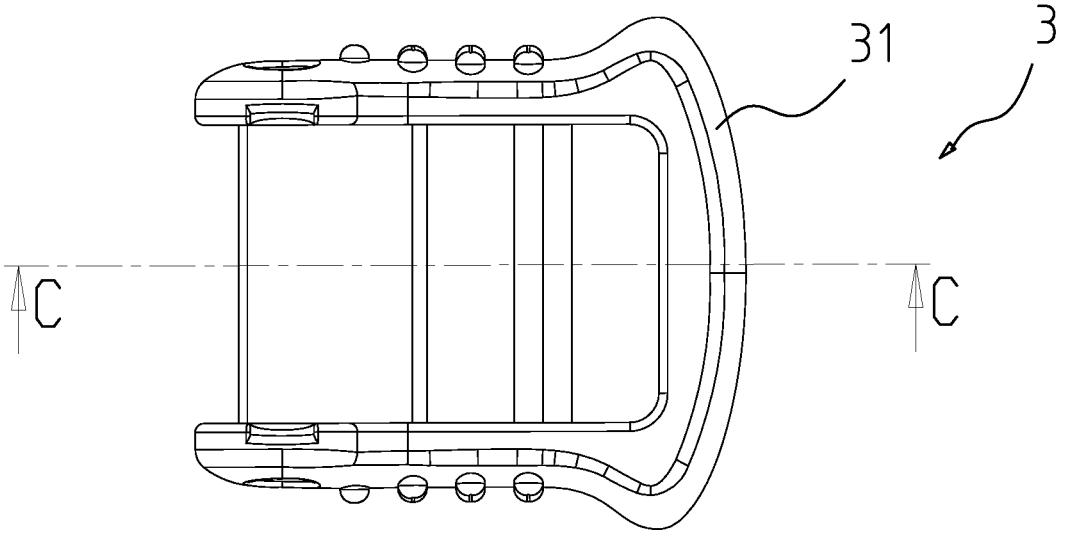
Figure 7C:
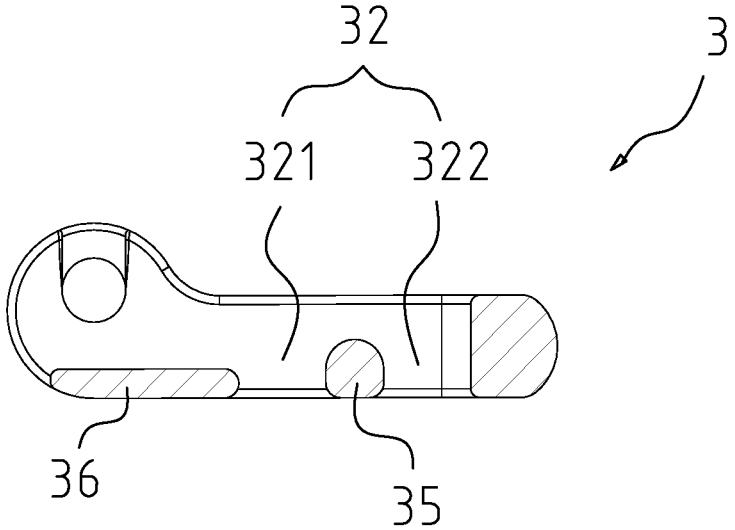
Figure 8A:
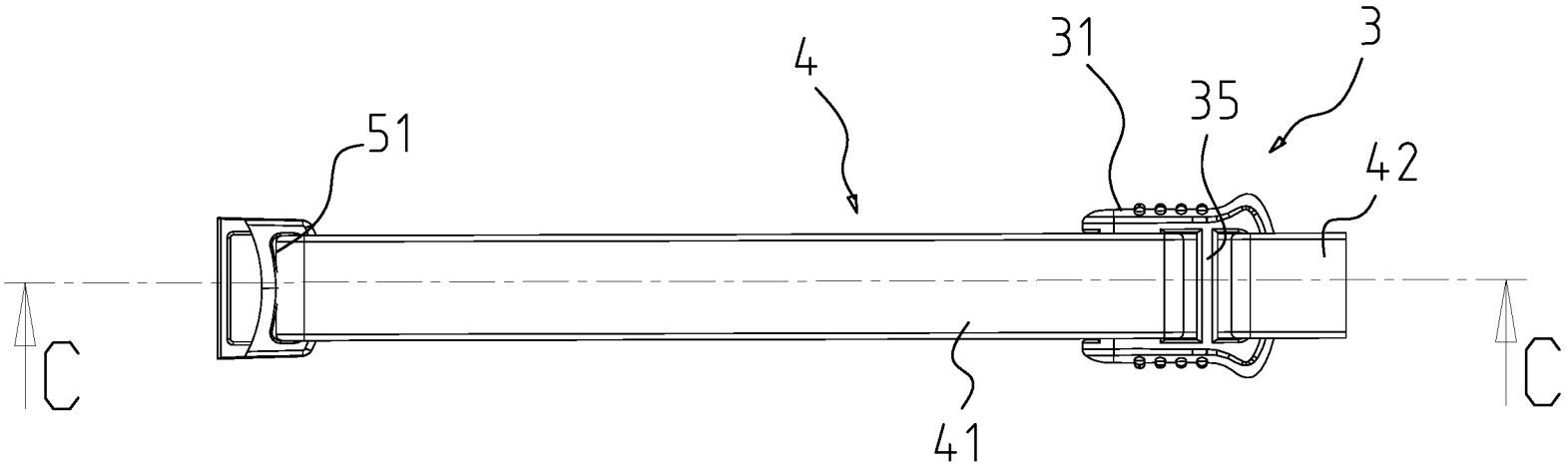
FIGS. 8A to 8C are a plan view, a top view and a cross-sectional view of 8C-8C of the head strap assembled on the adjustment buckle for adjustment.
Figure 8B:
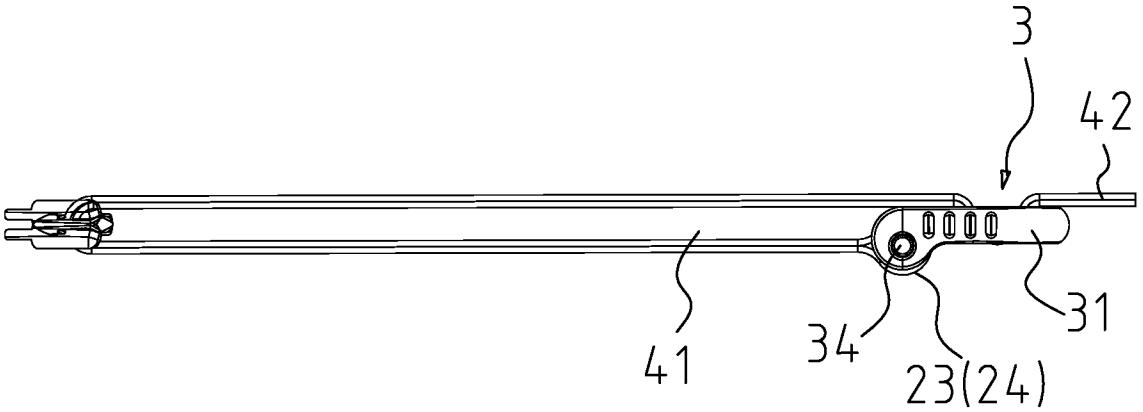
Figure 8C:
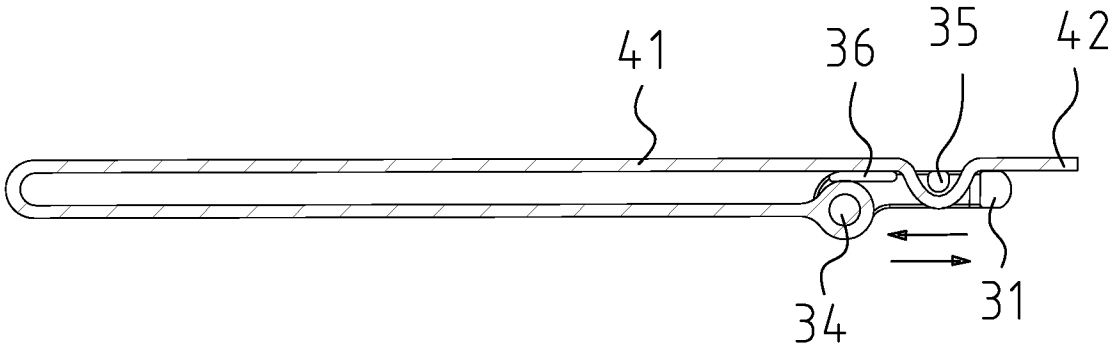

Please continue to refer to FIGS. 7A to 7C for the perspective view, plan view, and 7B-7B cross-sectional views of the adjustment buckle of the head strap device of the present invention. As shown in the figures, the head strap device of the present invention further includes an adjustment buckle 3. The adjusting buckle 3 includes a body 31, the body 31 is provided with an opening 32, and the side of the opening 32 is provided with a pin hole 33 for a pin 34 to be assembled; a guide post 35 is disposed away from the pin hole 33 on the opening 32, and the guide post 35 divides the opening 32 into a first through hole 321 and a second through hole 322. In addition, the body 31 on the side of the pin hole 33 is provided with a partition 36, which shields a part of the first through hole 321, and can be separated by the partition 36 when the head strap is threaded and overlapped, so as to reduce friction. Please refer to FIGS. 8A to 8C for the head strap assembly on the body 31 of the adjustment buckle 3 for the head strap adjustment. As shown in the figure, the free end 42 of the head strap 4 is passed around the guide post 35 and then passed through wrap around the through hole 51 of the lens, and pass it back to the body 31 to align the sleeve 23 (24) of the free end 41 with the pin hole 33 and fix it on the body 31 of the adjusting buckle 3 by the pin 34, then the head strap 4 and the lens frame can be connected as a whole. When the head strap 4 is worn and adjusted, there is no need to take off the swimming goggles, just push the body 31 directly in front of the swimming goggles (as shown in FIG. 8C, the arrow point to the left). At this time, although the head strap 4 is passed through the body 31, but not overlapped each other due to be separated by the partition 36, and the head strap 4 can be easily adjusted to loosen; on the contrary, the adjustable head strap 4 is tightened by pushing it toward the back of the swimming goggles (As shown in FIG. 8C, the arrow point to the right). In the above-mentioned head strap adjustment process, when there is no pushing and pulling from external force, the head strap can maintain the function of fixing the length of the head strap due to the resistance of the buckle to change the angle. To summarize the above, the adjustment buckle 3 of the present invention can provide the head strap 4 adjustment directly, without removing the swimming goggles when worn, due to the pins 34 and the guide post 35 disposed with misaligned each other, and the partition 36 separated the overlapped head strap, thus can provide convenient use effect.

It is understood that the invention may be embodied in other forms within the scope of the claims. Thus the present examples and embodiments are to be considered in all respects as illustrative, and not restrictive, of the invention defined by the claims.

What is claimed is:

1. A head strap device, being assembled to a lens frame, wherein the head strap device at least comprises: a head strap having a first connecting section and a second connecting section, the first and second connecting sections being mounted to the lens frame, and a central section being mounted between the first and second connecting sections, wherein:

the central section of the head strap is a curved surface, which naturally fits a back of the head of a wearer, while worn, wherein:

the curved surface of the central section of the head strap has a top of the curved surface which is defined by a horizontal line connecting width centers of the first connecting section and the second connecting section, the curved surface of the central section of the head strap is divided by a length-directional axis of the head strap into an upper arc surface and a lower arc surface, in which the upper arc surface and the lower arc surface each has a first surface and a second surface, wherein the second surface of each of the upper arc surface and the lower arc surface is in contact with the back of the head of the wearer while worn, the upper arc surface of the curved surface further has an extended convex surface on the first surface of the upper arc surface, the extended convex surface being configured to be convex in an unloaded state and being a continuous ribbed decoration, and which is formed passing through a junction point of the upper arc surface and the lower arc surface, and is respectively extended along both sides of the first connecting section and the second connecting section of the head strap; the extended convex surface changes the pulling tension of the upper arc surface of the curved surface based on a direction and a magnitude of tension exerted on the head strap while worn, balancing the extension magnification of the upper arc surface and the lower arc surface so that tensile forces of the head strap are balanced.

2. The head strap device of claim 1, wherein the upper arc surface and the lower arc surface of the curved surface extend symmetrically along the length-directional axis of the head strap.

3. The head strap device of claim 1, wherein the upper arc surface further has a plurality of drainage patterns formed on the second surface of the upper arc surface, and the plurality of drainage patterns having openings adjacent to the edges of the second surface of the upper arc surface, so that the formation of channels is conducive to drainage, and the sliding of the upper arc surface of the curved surface from the head of the wearer is reduced while worn when moving in the water.

4. The head strap device of claim 1, wherein the first connecting section and the second connecting section of the head strap are plate-shaped strips, and a shaft sleeve is provided at ends of the plate-shaped strips.

5. The head strap device of claim 1, wherein an elongated opening is formed between the upper arc surface and the lower arc surface of the curved surface.

6. The head strap device of claim 5, wherein the elongated opening is formed symmetrically between the upper arc surface and the lower arc surface of the curved surface based on a horizontal line connecting the width centers of the first connecting section and the second connecting section of the head strap.

7. The head strap device of claim 1, further comprising an adjustment buckle having a body with an opening, having a pin hole on a side of the opening of the body for a pin assembly, and having a guide post on the side away from the pin hole, which divides the opening into a first through hole and a second through hole, and having a partition which is provided on the body near the side of the pin hole, and which shields a part of the first through hole;

once the head strap is adjusted, the head strap is arranged in a loose state by the wearer moving the body directly toward a front of a swimming goggles comprising the head strap, or arranged in a tension state by the wearer moving the body directly toward a back of the swimming goggles, without removing the swimming goggles.

8. A head strap device, being assembled to a lens frame, wherein the head strap device comprises: a head strap having a first connecting section and a second connecting section, the first and second connecting sections being mounted to the lens frame, and a central section being mounted between the first and second connecting sections; and an adjustment buckle for mounting the head strap and for positioning and adjusting the head strap, wherein:

the central section of the head strap being a curved surface, which naturally fits a back of the head of a wearer, while worn, wherein:

the curved surface of the central section of the head strap having a top of the curved surface, the top of the curved surface being defined by a horizontal line connecting width centers of the first connecting section and the second connecting section, the curved surface of the central section of the head strap being divided by a length-directional axis of the head strap into an upper arc surface and a lower arc surface, in which the upper arc surface and the lower arc surface each has a first surface and a second surface, wherein the second surface of each of the upper arc surface and the lower arc surface contacts the back of the head of the wearer while worn, the upper arc surface of the curved surface further having an extended convex surface on the first surface of the upper arc surface, the extended convex surface being configured to be convex in an unloaded state and being a continuous ribbed decoration, and being formed passing through a junction point of the upper arc surface and the lower arc surface, and being respectively extended along both sides of the first connecting section and the second connecting section of the head strap; the extended convex surface changes the pulling tension of the upper arc surface of the curved surface based on a direction and a magnitude of tension exerted on the head strap while worn, balancing the extension magnification of the upper arc surface and the lower arc surface so that tensile forces of the head strap are balanced;

the adjustment buckle having a body with an opening; a pin and a guide post arranged misaligned with each other in the opening to form a first through hole and a second through hole; a partition which is disposed on a side of the opening of the body, and which shields a part of the first through hole;

once the head strap is adjusted, the head strap is arranged in a loose state by the wearer moving the body directly toward a front of a swimming goggles comprising the head strap, or arranged in a tension state by the wearer moving the body directly toward a back of the swimming goggles, without removing the swimming goggles.

9. The head strap device of claim 8, wherein the upper arc surface and the lower arc surface of the curved surface extend symmetrically along a length axis of the head strap.

10. The head strap device of claim 8, wherein the upper arc surface further has a plurality of drainage patterns formed on the second surface of the upper arc surface, the plurality of drainage patterns having openings adjacent to the edges of the second surface of the upper arc surface, so that the formation of channels is conducive to drainage, and the sliding of the upper arc surface of the curved surface from the head of the wearer is reduced while worn when moving in the water.

11. The head strap device of claim 8, wherein the first connecting section and the second connecting section of the head strap are plate-shaped strips, and a shaft sleeve is provided at ends of the plate-shaped strips.

12. The head strap device of claim 8, wherein an elongated opening is formed between the upper arc surface and the lower arc surface of the curved surface.

* * * * *